US005672084A

United States Patent [19]

Feldman

[11] Patent Number: 5,672,084

[45] Date of Patent: Sep. 30, 1997

[54] HIGH DENSITY CONNECTOR RECEPTACLE

[75] Inventor: Steven Feldman, Huntingdon, Pa.

[73] Assignee: Elco Corporation, Huntingdon, Pa.

[21] Appl. No.: 413,170

[22] Filed: Mar. 29, 1995

[51] Int. Cl.[6] ..... H01R 11/22

[52] U.S. Cl. ..... 439/852; 439/856

[58] Field of Search ..... 439/856, 852, 439/851, 853, 857

[56] References Cited

U.S. PATENT DOCUMENTS

| | | | |
|---|---|---|---|
| 4,593,963 | 6/1986 | Endo et al. | 439/852 |
| 4,973,273 | 11/1990 | DePriest | 439/856 |
| 5,281,175 | 1/1994 | Chupak et al. | 439/852 |

FOREIGN PATENT DOCUMENTS

| | | | |
|---|---|---|---|
| 0354064 | 2/1990 | European Pat. Off. | 439/852 |
| 2 548 837 | 7/1984 | France . | |
| 622468 | 5/1949 | United Kingdom . | |
| 2211 034 | 6/1989 | United Kingdom . | |
| WO 8602206 | 4/1986 | WIPO | 439/851 |
| WO 92/04746 | 3/1992 | WIPO . | |

*Primary Examiner*—David L. Pirlot
*Assistant Examiner*—Eugene G. Byrd
*Attorney, Agent, or Firm*—Loeb & Loeb

[57] ABSTRACT

An electrical socket contact which is connectable to a pin contact by insertion movement of the pin contact into the socket contact in an insertion direction. The socket contact includes: a body portion having elements for securing the socket contact in an opening in a receptacle housing so that the body portion is fixed in position in the receptacle; a first beam cantilevered to the body portion; a second beam having a proximal end cantilevered to the first beam and having a distal end spaced a distance from the first beam in a direction away from the first beam and parallel to the insertion direction; a first contact element located at the distal end of the second beam; a support arm secured to the proximal end of the second beam and having a distal end spaced a distance from the proximal end of the second beam in a direction away from the first beam and parallel to the insertion direction; and a second contact element located at the distal end of the support arm. The first and second beams are both flexible in a first direction transverse to the insertion direction and, during insertion of a contact pin into the socket, the pin moves the contact elements away from one another in the first direction.

16 Claims, 1 Drawing Sheet

HIGH DENSITY CONNECTOR RECEPTACLE

BACKGROUND OF THE INVENTION

The present invention relates to socket contacts which can be installed in a housing with a small spacing between contacts for connection to a corresponding array of conductive pins that are insertable into the socket contacts to form a connector. Connectors of this type are typically employed in electronic equipment, including computers.

In order for connectors of this type to perform their intended function in a satisfactory manner, the following basic requirements must be satisfied: the force required to insert the pins into the socket contacts, or insertion force, must be sufficiently low to avoid bending of the pins during insertion; and the socket contacts must be configured to assure that a suitable contact pressure is established between the pins and the socket contacts, while allowing for some inaccuracies in the positioning of individual pins.

Receptacle-type contacts are commonly manufactured by stamping a metal sheet to provide a carrier strip carrying a plurality of socket contact blanks which must subsequently be bent into an appropriate shape. To facilitate automation of this fabrication procedure, the width of each socket contact blank can not be greater than the center-to-center spacing between a row of finished socket contacts. Since there is a continuing trend toward miniaturization of such connectors, which includes reduction in the center-to-center spacing between adjacent socket contacts, the formation of functionally satisfactory socket contacts by such a stamping procedure becomes increasing difficult. Currently, there is a demand for receptacles having one or more rows of socket contacts, with the socket contacts in each row having a 50 mil (0.050 inch) center-to-center spacing.

One type of receptacle socket contact which has been recently proposed is known as a dual-beam receptacle socket contact. A contact of this type includes a pair of beams configured to trap a contact pin therebetween. Each beam carries a conductive contact element arranged to contact an inserted pin. The two contact elements are disposed to contact opposite sides of a connecting pin and are offset from one another in the direction of pin insertion. The beams are formed to maintain a certain spacing between the contact elements, in a direction perpendicular to the pin insertion direction, sufficient to allow easy pin insertion while producing the requisite contact force when a pin has been inserted.

It is known in the art to apply a biasing, or preload, force to the beams in the receptacle housing so that when a pin is not coupled to the socket contact, the desired spacing exists between the contact elements in the direction perpendicular to the pin insertion direction, while one or both beams is elastically deformed. Thus, when a pin is inserted between the contact elements, the elements will bear against the pin with a sufficient contact force.

A dual-beam socket contact of the type described above is disclosed in U.S. Pat. No. 4,973,273. As is shown in FIGS. 6 and 7 of that patent, the preloading force is produced by engagement of tabs at the free ends of the beams with a ramp forming an integral part of the receptacle housing.

Dual-beam socket contacts of the type described above are also disclosed in U.S. Pat. Nos. 4,140,361; 4,591,230; 4,607,907; and 4,702,545. Various socket contact designs are also disclosed in U.S. Pat. Nos. 3,058,091; 3,142,891; 3,634,806; 4,778,231; and 4,859,198.

SUMMARY OF THE INVENTION

It is an object of the present invention to provide an improved dual-beam socket contact which can be formed by stamping a flat metal sheet to produce a plurality of such contacts having a small center-to-center spacing.

Another object of the invention is to provide a socket contact of the above-described type having simplified structure for achieving beam preloading.

Another object of the invention is to provide socket contacts which can be secured in a housing while subjecting the housing walls to reduced stress in comparison with that achieved with known structures.

The above and other objects are achieved, according to the present invention, by the provision of an electrical socket contact which is connectable to a pin contact by insertion movement of the pin contact into the socket contact in an insertion direction, the socket contact comprising: a body portion having elements for securing the socket contact in an opening in a receptacle housing so that the body portion is fixed in position in the receptacle; a first beam having a proximal end cantilevered to the body portion and a distal end spaced a distance from the proximal end in a direction away from the body portion and parallel to the insertion direction; a second beam having a proximal end cantilevered to the distal end of the first beam and a distal end spaced a distance from the proximal end of the second beam in a direction away from the first beam and parallel to the insertion direction; a first contact element located at the distal end of the second beam; a support arm having a proximal end secured to the proximal end of the second beam and a distal end spaced a distance from the proximal end of the second beam in a direction away from the first beam and parallel to the insertion direction; and a second contact element located at the distal end of the support arm, wherein the first and second beams are both flexible in a first direction transverse to the insertion direction and during insertion of a contact pin into the socket, the pin moves the contact elements away from one another in the first direction.

DESCRIPTION OF THE PREFERRED EMBODIMENTS

Figure 1:
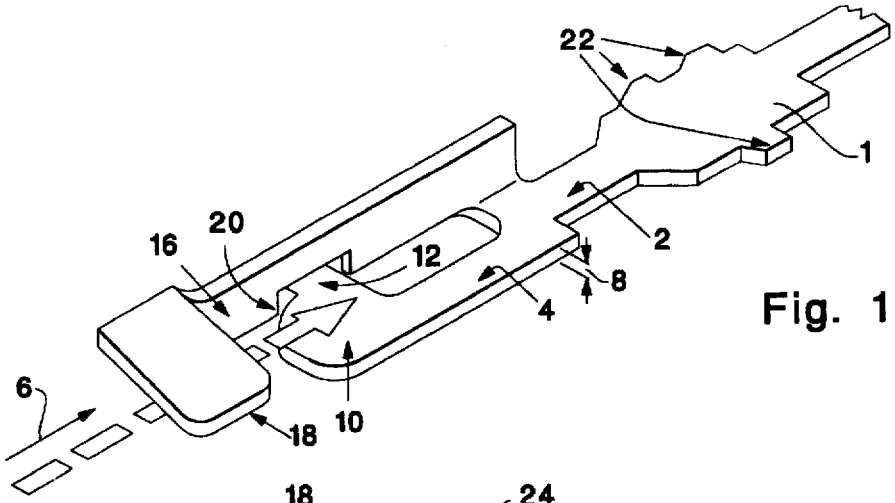
FIG. 1 is a perspective view of a preferred embodiment of a socket contact according to the present invention.

FIG. 1 illustrates a preferred embodiment of a socket contact according to the invention which is formed by stamping a pattern for a plurality of such contacts in a flat metal blank, for example of spring metal; and then bending portions of the contact blank to form the final contact structure which is illustrated.

Portions of the socket contact include body portion 1, a first beam 2 and a second beam 4, these two beams following one another and extending in pin insertion direction 6. Each of beams 2 and 4 is formed in a portion of the socket contact whose thickness dimension 8 is perpendicular to insertion direction 6 and to the direction of flexure of those beams during insertion of a pin. Beam 2 is narrower than body portion 1 and beam 4.

The free end, or distal end, of second beam 4 carries a contact element 10 which extends transversely to beam 4 in the direction transverse to thickness dimension 8. The lateral free end of contact element 10 is provided with a preloading tab 12.

The socket contact further includes an arm 16 which is joined to the portions described above essentially at the boundary between beams 2 and 4 and is formed by bending the sheet material about an axis which is parallel to insertion direction 6. At the free end, or distal end, of arm 16, the bland is bent about an axis parallel to insertion direction 6 to form a second contact element 18. Arm 16 is provided with a notch 20 which receives tab 12.

Contact elements 10 and 18 are spaced apart in a direction perpendicular to insertion direction 6 and parallel to the direction of flexure of beams 2 and 4 and are also offset from one another in insertion direction 6.

When, during pin insertion, the pin contacts element 18, arm 16 will not flex relative to the remainder of the socket contact because it is relatively rigid in the direction of the force imposed by the pin on contact element 18. However, during initial insertion of the pin, when the pin contacts element 18, both arm 16 and beam 4 can be deflected as a unit as a result of flexing of beam 2. This allows the socket contact to adjust to misalignment of the pin while maintaining the initial spacing between elements 10 and 18 in the direction perpendicular to insertion direction 6. Then, when the pin moves into contact with element 10, element 10 will be deflected downwardly while beam 4 flexes. As a result, the pin will be firmly gripped between contact elements 10 and 18 while the socket contact is permitted to be displaced to accommodate misalignments of the contact pin.

Due to the cooperation between tab 12 and notch 20, beam 4 is biased into a deflected, or stressed, state when no pin is present in the socket contact. Therefore, a defined spacing exists between elements 10 and 18, in the beam deflection direction, and beam 4 is preloaded, before insertion of a pin. When a pin is inserted, the pin will be gripped between contact elements 10 and 18 with an appropriate contact force.

Body portion 1, at the rear end of the socket contact, is an enlarged portion via which the contact will be securely held in a receptacle, such receptacle typically being made of a thermoplastic material. According to a further feature of the invention, this region of the socket contact is provided with alternating barbs 22, the barb 22 along one edge being offset relative to the barbs 22 along the other edge with respect to insertion direction 6. This barb arrangement serves to reduce stress on the housing wall between adjacent socket contacts, which is beneficial when a small center-to-center spacing exists between adjacent contacts.

Referring to FIGS. 2–5, there is shown a portion of a receptacle which contains a plurality of socket contacts according to the invention. The receptacle is composed of a housing 24 containing the plurality of socket contacts. It will be understood that a plurality of socket contacts are disposed in respective housing recesses, the housing contacts being spaced apart in a direction perpendicular to the plane of FIGS. 2 and 4. Each recess has a pin insertion opening.

Figure 2:
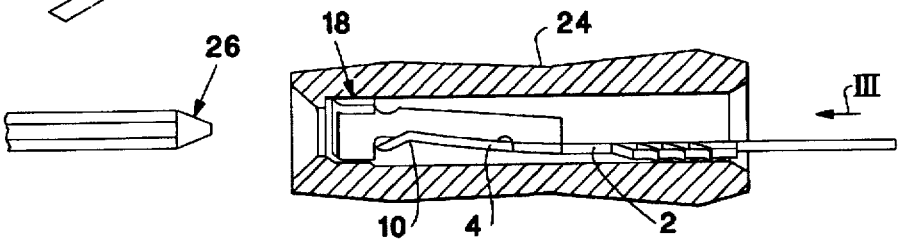
FIG. 2 is a side elevational view of a socket contact according to the invention installed in a receptacle housing, with the associated pin withdrawn.
Figure 3:
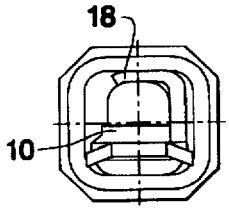
FIG. 3 is a rear end view of the arrangement of FIG. 2, taken in the direction of arrow III of FIG. 2.
Figure 4:
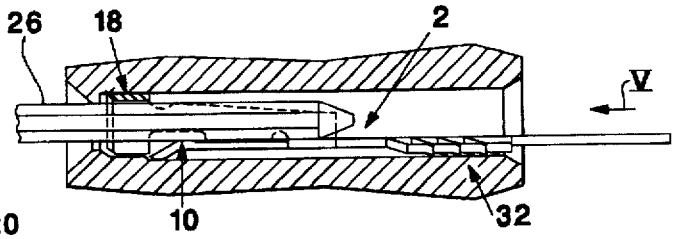
FIG. 4 is a view similar to that of FIG. 2 with a pin inserted into the socket contact.
Figure 5:
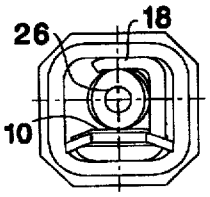
FIG. 5 is a view similar to that of FIG. 3 taken in the direction of the arrow V of FIG. 4.

In FIG. 2, pin 26 has not as yet been inserted into the associated socket contact, and the socket contact has a certain freedom of movement in the vertical direction of FIG. 2. This movement is limited by suitably located abutment surfaces formed by portions of the housing recess wall adjacent the pin insertion opening. Pin 26 is one of a plurality of pins provided on a male connector and these pins may be misaligned, or offset from one another in the vertical direction of FIG. 2. The vertical freedom of movement of each socket contact, facilitated by beam 2, allows each socket contact to accommodate such misalignment.

A receptacle provided with socket contacts according to the present invention is intended to be utilized with straight pins 26 having any appropriate cross-sectional shape and a tapered free end. Each such pin 26 has a uniform cross section along its length, apart from the tapered end.

Figure 6:
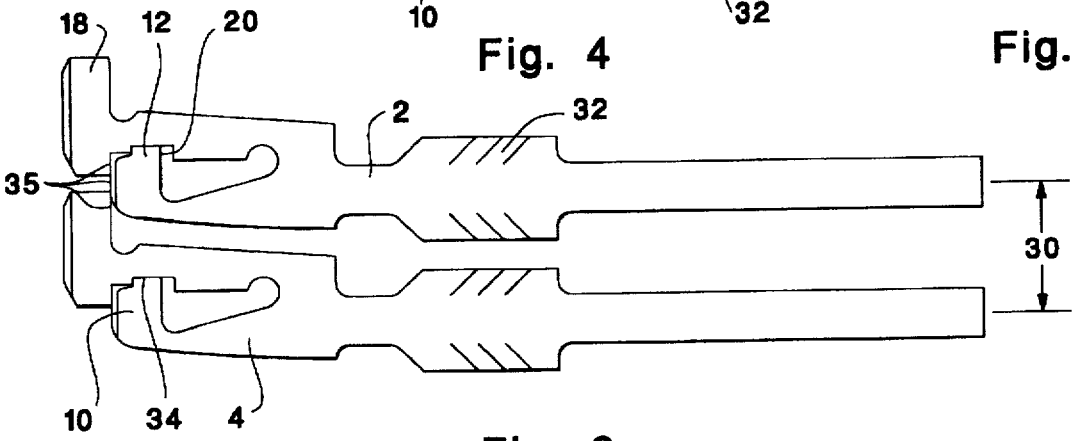
FIG. 6 is a plan view showing a portion of a flat blank which has been stamped to produce blanks for two socket contacts substantially according to the embodiment of FIG. 1.

FIG. 6 is a plan view showing two socket contact blanks which have been stamped in a sheet that is also provided with a carrier strip (not shown) which carries the socket contact blanks, after they have been stamped, through shaping apparatus. On the carrier strip, the socket blanks are spaced apart by a distance 30 which is equal to the center-to-center spacing between socket contacts in housing 24. Thus, it is possible to gang-insert the socket contacts, after they have been properly bent, into uniformly spaced apart contact-receiving openings provided in housing 24. After insertion, the carrier strip is cut away from the socket contacts.

In accordance with the invention, creation of the blank shown in FIG. 6 includes shear forming of certain edges of each arm 16, each tab 12, each contact element 10 and each contact element 18, for example along lines 34 and 35 in FIG. 6. Shear forming creates the edges with minimum material removal. This technique minimizes overall material removal, maximizes the width of arm 16 in the region of tab 12 and maximizes the width of each contact element 10, 18. This helps to give arm 16 and contact elements 10, 18 the requisite stiffness. It also gives tab 12 a length perpendicular to line 34, that assures reliable engagement in the cooperating notch 20 in arm 16.

The socket contacts of the embodiment shown in FIGS. 2–6 have a body portion 32 provided with fastening barbs which are bent downwardly, instead of projecting horizontally as in FIG. 1.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electrical socket contact which is connectable to a pin contact by insertion movement of the pin contact into said socket contact in an insertion direction, said socket contact comprising:

a body portion having elements for securing said socket contact in an opening in a receptacle housing so that said body portion is fixed in position in the receptacle;

a first beam having a proximal end cantilevered to said body portion and a distal end spaced a distance from said proximal end in a direction away from said body portion and parallel to the insertion direction;

a second beam having a proximal end cantilevered to said distal end of said first beam and a distal end spaced a distance from said proximal end of said second beam in a direction away from said first beam and parallel to the insertion direction;

a first contact element located at said distal end of said second beam;

a support arm having a proximal end secured to said proximal end of said second beam and a distal end spaced a distance from said proximal end of said second beam in a direction away from said first beam and parallel to the insertion direction; and a second contact element located at said distal end of said support arm, wherein said first and second beams are both flexible in a first direction transverse to the insertion direction and during insertion of a contact pin into said socket, the pin moves the contact elements away from one another in the first direction, and said contact further comprises preload means coupling said second beam to said support arm for flexing said second beam when there is no contact pin in said contact socket.

2. A contact as defined in claim 1 wherein the distance between said distal end of said second beam and said proximal end of said second beam is less than the distance between said distal end of said support arm and said proximal end of said second beam, whereby during insertion of a contact pin into said socket, the contact pin initially contacts said second contact element to cause flexing of said first beam.

3. A contact as defined in claim 2 wherein said first beam has a width, said body portion has a width, each width being in a second direction perpendicular to the first direction and the width of said first beam being less than the width of said second beam.

4. A contact as defined in claim 3 wherein said preload means comprise: a portion of said support arm which is provided with a notch; and a tab carried by said first contact element and engaging in said notch.

5. A contact as defined in claim 4 wherein said body portion has two side edges which extend parallel to the insertion direction, and said elements for securing said socket contact comprise at least one barb disposed on each of said side edges, with said barb on one of said side edges being offset from said barb on the other one of said side edges in the insertion direction.

6. A contact as defined in claim 5 wherein there are two said barbs on one of said side edges.

7. A receptacle comprising: a housing provided with a plurality of socket-receiving openings; and a plurality of contacts, each as defined in claim 6 and each held in a respective opening.

8. A contact as defined in claim 1 wherein said first beam has a width, said body portion has a width, each width being in a second direction perpendicular to the first direction and the width of said first beam being less than the width of said second beam.

9. A contact as defined in claim 1 wherein said preload means comprise: a portion of said support arm which is provided with a notch; and a tab carried by said first contact element and engaging in said notch.

10. A contact as defined in claim 1 wherein said preload means maintain a spacing between said first beam and said second beam in the first direction when there is no contact pin in said contact socket.

11. A contact as defined in claim 1 wherein said body portion has two side edges which extend parallel to the insertion direction, and said elements for securing said socket contact comprise at least one barb disposed on each of said side edges, with said barb on one of said side edges being offset from said barb on the other one of said side edges in the insertion direction.

12. A contact as defined in claim 11 wherein there are two said barbs on one of said side edges.

13. A receptacle comprising: a housing provided with a plurality of socket-receiving openings; and a plurality of contacts, each as defined in claim 12 and each held in a respective opening.

14. A receptacle comprising: a housing provided with a plurality of socket-receiving openings; and a plurality of contacts, each as defined in claim 1 and each held in a respective opening.

15. A receptacle as defined in claim 14 wherein each said opening is dimensioned to give the socket contact held therein a freedom of movement in the first direction to compensate for misalignment of the associated pin contact.

16. A receptacle as defined in claim 14 wherein:

said plurality of contacts are disposed in a row with a pitch between contacts in a second direction perpendicular to the insertion direction and to the first direction; and each of said contacts is formed from an initially flat blank which has a width, in the second direction, which is greater than the pitch, said blank having first and second portions which form the first and second contact elements and which overlap one another in the second direction.

* * * * *